US010068514B2

(12) United States Patent
Lin et al.

(10) Patent No.: US 10,068,514 B2
(45) Date of Patent: Sep. 4, 2018

(54) ELECTRONIC PAPER DISPLAY APPARATUS AND A DETECTION METHOD THEREOF

(71) Applicant: E Ink Holdings Inc., Hsinchu (TW)

(72) Inventors: Sheng-Long Lin, Hsinchu (TW); Yao-Te Tseng, Hsinchu (TW); Ian French, Hsinchu (TW); Pei-Sheng Lee, Hsinchu (TW); Feng-Chuan Yeh, Hsinchu (TW); Po-Sen Chen, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 38 days.

(21) Appl. No.: 15/077,934

(22) Filed: Mar. 23, 2016

(65) Prior Publication Data

US 2017/0011677 A1 Jan. 12, 2017

(30) Foreign Application Priority Data

Jul. 7, 2015 (TW) ..... 104122030 A

(51) Int. Cl.

| | |
|---|---|
| ***G09G 5/00*** | (2006.01) |
| ***G09G 3/20*** | (2006.01) |
| ***G09G 3/00*** | (2006.01) |
| ***G09G 3/34*** | (2006.01) |

(52) U.S. Cl.

CPC ..... *G09G 3/2003* (2013.01); *G09G 3/006* (2013.01); *G09G 3/344* (2013.01); *G09G 2310/0213* (2013.01); *G09G 2310/0243* (2013.01); *G09G 2330/12* (2013.01); *G09G 2380/14* (2013.01)

(58) Field of Classification Search

CPC combination set(s) only.
See application file for complete search history.

(56) References Cited

U.S. PATENT DOCUMENTS

| | | | | |
|---|---|---|---|---|
| 2005/0099413 | A1 | 5/2005 | Chiu et al. | |
| 2006/0227638 | A1* | 10/2006 | Kudo | G09G 3/20 365/203 |
| 2009/0174646 | A1 | 7/2009 | Lim | |
| 2009/0207352 | A1 | 8/2009 | Moriyama et al. | |
| 2009/0225107 | A1 | 9/2009 | Nose et al. | |

(Continued)

OTHER PUBLICATIONS

"Office Action of Taiwan Counterpart Application", dated Jun. 14, 2016, p. 1-p. 8, in which the listed reference was cited.

*Primary Examiner* — Temesghen Ghebretinsae
*Assistant Examiner* — Sosina Abebe
(74) *Attorney, Agent, or Firm* — JCIPRNET

(57) ABSTRACT

An electronic paper display apparatus including a display driving unit, an electronic paper display panel and a detection circuit unit is provided. The display driving unit generates at least one driving signal. The electronic paper display panel is coupled to the display driving unit. The display driving unit drives the electronic paper display panel to display an image by the at least one driving signal, and the electronic paper display panel outputs the at least one driving signal. The detection circuit unit is coupled to the electronic paper display panel to receive the at least one driving signal outputted by the electronic paper display panel, and detect a display status of the electronic paper display panel according to the at least one driving signal. Besides, a detection method of an electronic paper display apparatus is also provided.

16 Claims, 5 Drawing Sheets

(56) References Cited

U.S. PATENT DOCUMENTS

| | | | | |
|---|---|---|---|---|
| 2010/0110029 | A1* | 5/2010 | Yamamoto | G06F 3/0412 345/173 |
| 2010/0207924 | A1* | 8/2010 | Saito | G09G 3/344 345/211 |
| 2011/0157256 | A1* | 6/2011 | Sakamoto | G09G 3/344 345/690 |
| 2011/0199344 | A1 | 8/2011 | Kimura et al. | |
| 2012/0098803 | A1 | 4/2012 | Chang | |
| 2013/0057943 | A1 | 3/2013 | Shih et al. | |
| 2013/0187898 | A1 | 7/2013 | Lee et al. | |
| 2014/0078133 | A1 | 3/2014 | Lee et al. | |
| 2014/0097943 | A1 | 4/2014 | Moon et al. | |
| 2014/0125645 | A1 | 5/2014 | Ghaderi et al. | |
| 2014/0285465 | A1* | 9/2014 | Hayashi | G06F 3/044 345/174 |
| 2014/0312908 | A1 | 10/2014 | Lemons et al. | |
| 2015/0301654 | A1* | 10/2015 | Chen | G06F 3/044 345/174 |

* cited by examiner

ELECTRONIC PAPER DISPLAY APPARATUS AND A DETECTION METHOD THEREOF

CROSS-REFERENCE TO RELATED APPLICATION

This application claims the priority benefit of Taiwan application serial no. 104122030, filed on Jul. 7, 2015. The entirety of the above-mentioned patent application is hereby incorporated by reference herein and made a part of this specification.

BACKGROUND OF THE INVENTION

1. Field of the Invention

The invention relates to a display apparatus and a detection method thereof, and relates particularly to an electronic paper display apparatus and a detection method thereof.

2. Description of Related Art

In recent years, mobile devices such as tablet PCs and smart phones have been developing at a rapid rate, and consequently has also brought innovations in display technology. Among the many display technologies, the reading experience of an electronic paper (e-Paper) display is similar to the reading experience of printed paper and printed writing, therefore a user feels more comfortable when reading. In addition, compared to other display technologies, electronic paper displays consume a significantly smaller amount of power and is suitable for long periods of use. Therefore, in recent years, many technologies and applications related to electronic paper displays have been proposed.

Currently, electronic paper displays have been used in some electronic billboards, cell phone screens, or on wearable electronic devices. In addition, currently there are electronic paper displays used in electronic signage of a department store, or electronic paper displays used in a train station time table or information bulletin board. However, if a chip or panel of the electronic paper display is damaged, the electronic paper display may display wrong information, therefore causing a viewer to receive outdated information or wrong information.

SUMMARY OF THE INVENTION

The invention provides an electronic paper display apparatus to detect a display state of the electronic paper display panel.

The invention provides a detection method of an electronic paper display apparatus to detect a display state of the electronic paper display panel.

An embodiment of the invention provides an electronic paper display apparatus, the electronic paper display apparatus includes a display driving unit, an electronic paper display panel and a detection circuit unit. The display driving unit generates at least one driving signal. The electronic paper display panel is coupled to the display driving unit. The display driving unit drives the electronic paper display panel to display an image using a driving signal. The electronic paper display panel outputs the driving signal. The detection circuit unit is coupled to the electronic paper display panel, and configured to receive the driving signal outputted by the electronic paper display panel, and detects a display state of the electronic paper display panel according to the driving signal.

In an embodiment of the invention, the electronic paper display panel includes at least one display driving line. The display driving line is coupled to the display driving unit.

The display driving unit transmits the driving signal through the display driving line, so as to drive the electronic paper display panel to display the image using a driving signal. The detection circuit unit receives the driving signal outputted by the electronic paper display panel through the display driving line.

In an embodiment of the invention, the driving signal includes a plurality of driving signals and the display driving unit includes a plurality of display driving circuits. The display driving circuit is configured to generate the driving signals.

In an embodiment of the invention, the electronic paper display panel includes a plurality of image display regions. The display driving circuits drive the image display regions respectively to display the image by using the driving signals.

In an embodiment of the invention, the image display regions outputs the driving signals to the detection circuit unit through a plurality of signal transmitting paths. The detection circuit unit detects the display state of the electronic paper display panel according to the driving signals.

In an embodiment of the invention, the electronic paper display apparatus further includes a multiplexer circuit. The multiplexer circuit is coupled between the electronic paper display panel and the detection circuit unit. The multiplexer circuit is configured to switch the signal transmitting paths, such that the detection circuit unit receives the driving signals generated from the display driving circuits sequentially.

In an embodiment of the invention, the detection circuit unit includes one or more signal detection channels, each of the signal detection channels. Each of the signal detection channels include a comparison circuit. The comparison circuit is coupled to the electronic paper display panel. The comparison circuit is configured to receive the at least one driving signal outputted by the electronic paper display panel. The comparison circuit performs a comparison of the at least one driving signal with a reference signal, so as to output a comparison result to detect the display state of the electronic paper display panel.

In an embodiment of the invention, each of the signal detection channels further include a signal conversion circuit and a buffer circuit. The signal conversion circuit is coupled between the comparison circuit and the electronic paper display panel. The signal conversion circuit is configured to divide the at least one driving signal so as to output the at least one driving signal after being divided. The buffer circuit is coupled between the signal conversion circuit and the comparison circuit. The buffer circuit is configured to increase the driving ability of the at least one driving signal after being divided.

In an embodiment of the invention, each of the signal detection channels further include a signal generation circuit coupled to the comparison circuit. The signal generation circuit is configured to generate a reset signal to reset the comparison circuit.

In an embodiment of the invention, the one or more signal detection channels output the comparison result to a control unit. The control unit determines the display state of the electronic paper display panel according to the comparison result.

In an embodiment of the invention, the control unit controls whether the display driving unit drives the electronic paper display panel to display the image or not.

An embodiment of the invention provides a detection method of an electronic paper display apparatus, configured to detect a display state of the electronic paper display apparatus. The electronic paper display apparatus includes a display driving unit, an electronic paper display panel and a detection circuit unit. The detection method of the electronic paper display apparatus includes outputting at least one driving signal to drive the electronic paper display panel to display an image, and detecting the display state of the electronic paper display panel according to the at least one driving signal outputted by the electronic paper display panel.

In an embodiment of the invention, in the step of outputting the at least one driving signal to drive the electronic paper display panel to display the image, the at least one driving signal is outputted to the electronic paper display panel through at least one display driving line of the electronic paper display panel. The detection method of the electronic paper display apparatus further includes receiving the at least one driving signal outputted by the electronic paper display panel through the at least one display driving line, so as to detect the display state of the electronic paper display panel.

In an embodiment of the invention, the electronic paper display panel includes a plurality of image display regions, the driving signal includes a plurality of driving signals. In the step of outputting the at least one driving signal to drive the electronic paper display panel to display the image, the image display regions are respectively driven to display the image by using the driving signals.

In an embodiment of the invention, the image display regions output the driving signals through a plurality of signal transmitting channels respectively. The detection method of the electronic paper display apparatus further includes switching the signal transmitting paths sequentially. The step of detecting the display state of the electronic paper display panel according to the at least one driving signal outputted by the electronic paper display panel includes receiving the driving signals from the display driving circuits sequentially.

In an embodiment of the invention, the step of detecting the display state of the electronic paper display panel according to the at least one driving signal outputted by the electronic paper display panel includes receiving the at least one driving signal outputted by the electronic paper display panel; and performing a comparison of the at least one driving signal with a reference signal, so as to output a comparison result to detect the display state of the electronic paper display panel.

In an embodiment of the invention, the step of detecting the display state of the electronic paper display panel according to the at least one driving signal outputted by the electronic paper display panel further includes dividing the at least one driving signal, so as to output the at least one driving signal after being divided and increasing the driving ability of the at least one driving signal after being divided. In the step of performing a comparison of the at least one driving signal with a reference signal, a comparison of the at least one driving signal after being divided having increased driving ability with the reference signal is performed.

In an embodiment of the invention, the step of detecting the display state of the electronic paper display panel according to the at least one driving signal outputted by the electronic paper display panel includes generating a reset signal to reset the comparison result.

In an embodiment of the invention, the detection method of the electronic paper display apparatus further includes determining the display state of the electronic paper display panel according to the comparison result.

In an embodiment of the invention, the detection method of the electronic paper display apparatus further includes determining whether to output the at least one driving signal to drive the electronic paper display panel to display the image or not according to a determined result.

Based on the above, in the electronic paper display apparatus and the detection method thereof of the embodiments of the invention, the display driving unit of the electronic paper display apparatus drives the electronic paper display panel to display an image by the at least one driving signal. The detection circuit unit receives the driving signal outputted by the electronic paper display panel, and detects a display status of the electronic paper display panel according to the driving signal, therefore may perform detection on the display driving unit and the electronic paper display panel at the same time.

Several exemplary embodiments accompanied with figures are described in detail below to further describe the disclosure in details.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
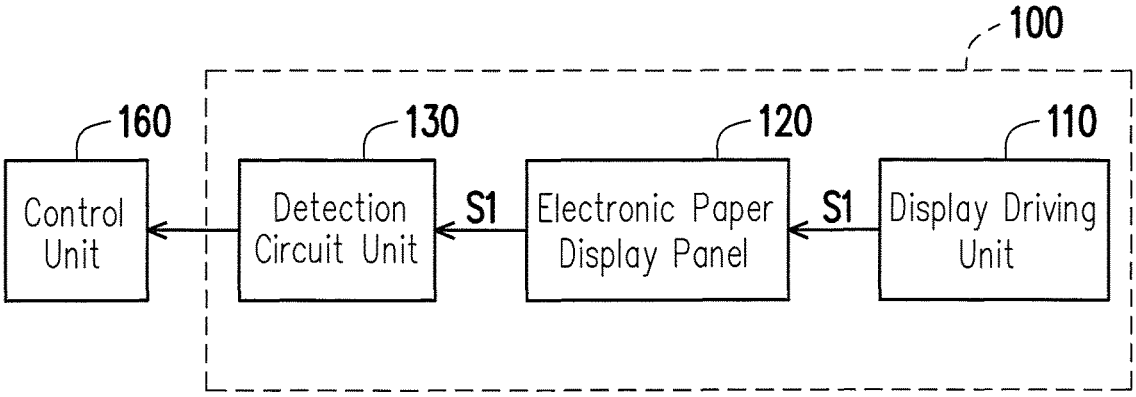
FIG. 1 is a schematic diagram illustrating an electronic paper display apparatus according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic diagram illustrating an electronic paper display apparatus according to an embodiment of the invention. Referring to FIG. 1, an electronic paper display apparatus 100 of the present embodiment includes a display driving unit 110, an electronic paper display panel 120 and a detection circuit unit 130. The electronic paper display panel 120 is coupled to the display driving unit 110. The detection circuit unit 130 is coupled to the electronic paper display panel 120. In the present embodiment, the display driving unit 110 is configured to generate a driving signal S1, wherein the driving signal S1 is configured to drive the electronic paper display panel 120 to display an image (not shown). The display driving unit 110, for example, includes a source driver or a gate driver. In addition, the electronic paper display panel 120 outputs the driving signal S1 to the detection circuit unit 130. In the present embodiment, the detection circuit unit 130 receives the driving signal S1 outputted by the electronic paper display panel 120, and detects a display status of the electronic paper display panel 120 according to the driving signal S1. Then, the detection circuit unit 130 outputs a detection result to a control unit 160, such that the control unit 160 may determine the display state of the electronic paper display panel 120, and then control whether the display driving unit 110 drives the electronic paper display panel 120 to display the image or not. The control unit 160, for example, may be a central processing unit (CPU), a microprocessor, a digital signal processor (DSP), a programmable controller, a programmable logic device (PLD) or other similar device or a combination of these devices.

Figure 2:
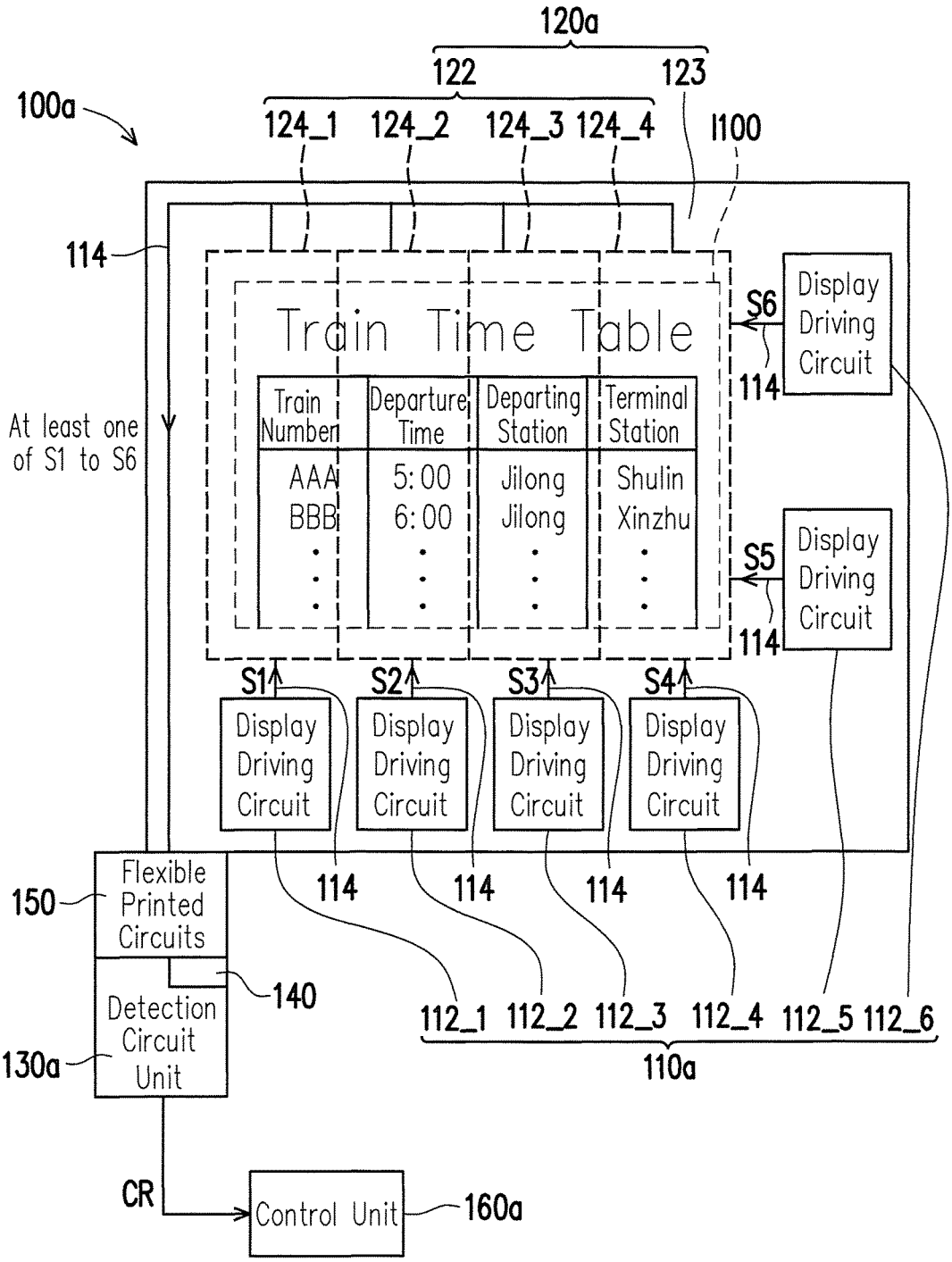
FIG. 2 is a schematic diagram illustrating an electronic paper display apparatus according to another embodiment of the invention.

FIG. 2 is a schematic diagram illustrating an electronic paper display apparatus according to another embodiment of the invention. Referring to FIG. 2, an electronic paper display apparatus 100*a* of the present embodiment includes a display driving unit 110*a*, an electronic paper display panel 120*a* and a detection circuit unit 130*a*. The electronic paper display panel 120*a* is coupled to the display driving unit 110*a*. The detection circuit unit 130*a* is coupled to the electronic paper display panel 120*a*. In the present embodiment, the display driving unit 110*a* includes display driving circuits 112_1 to 112_6, and are configured to generate driving signals S1 to S6 respectively. In the present embodiment, the display driving circuits 112_1 to 112_4, for example, include a source driver circuit, and the driving signals S1 to S4, for example, are source driver signals. The display driving circuits 112_1 to 112_4 generate the driving signals S1 to S4 respectively. In addition, the display driving circuits 112_5, 112_6, for example, include a gate driver circuit, and the driving signals S5, S6 are gate driver signals. The display driving circuits 112_5, 112_6 generate the driving signals S5, S6 respectively. However, the number and type of display driving circuits and driving signals should not be construed as a limitation to the invention. In some embodiments, the electronic paper display apparatus also may generate a driving signal using a single display driving circuit, and the driving signal may be, for example, a source driver signal or a gate driver signal.

In the present embodiment, the display driving unit 110*a* drives the electronic paper display panel 120*a* to display an image I100 by using at least one driving signal S1 to S6. More specifically, the image I100 may be any text, still image, dynamic image or a combination thereof. In addition, the image I100 also may be configured to provided any types of infatuation, for example, an advertisement, a map, an electronic ticket, a coupon and such, or for example, activities information or product information for a department store, train station time tables, train delay information and the like, and it should not be construed as a limitation to the invention. In the present embodiment, the electronic paper display panel 120*a* includes an active region 122 and a non-active region 123. The active region 122 includes a plurality of image display regions 124_1 to 124_4, and the display driving circuits 112_1 to 112_6 drive the image display regions 124_1 to 124_4 to display the image I100 by using the at least one driving signal S1 to S6. More specifically, the electronic paper display panel 120*a* may be an electronic paper display panel which may display black and white, and also may be an electronic paper display panel which may display color and it should not be construed as a limitation to the invention. In addition, in the present embodiment, the image display regions 124_1 to 124_6 are disposed in the non-active region 123, however in other embodiments, the image display regions 124_1 to 124_6 also may be disposed in regions other than the non-active region 123, for example, disposed independently of the electronic paper display panel 120*a*.

In the present embodiment, the electronic paper display panel 120*a* includes a display driving line 114. The display driving line 114 is coupled to the display driving unit 110*a*. The display driving unit 110*a* transmits the at least one driving signal S1 to S6 to drive the electronic paper display panel 120*a* to display the image I100 through the display driving line 114. For example, the display driving unit 110*a* transmits the driving signals S1 to S5 of the driving signals S1 to S6 to drive the electronic paper display panel 120*a* to display the image I100 through the display driving line 114. More specifically, the display driving line 114 is coupled to the display driving circuits 112_1 to 112_6. The display driving circuits 112_1 to 112_6 transmit the at least one driving signal S1 to S6 to drive the image display regions 124_1 to 124_4 of the electronic paper display panel 120*a* to display the image I100 through the display driving line 114. In addition, in other embodiments, the display driving unit 110*a* may also transmit the driving signals S1 to S6 to drive the electronic paper display panel 120*a* to display the image I100 through the display driving line 114. In addition, in other embodiments of the invention, a number of the display driving lines may be a plurality, for example, the display driving unit 110*a* may transmit the at least one driving signals S1 to S6 to drive the electronic paper display panel 120*a* to display the image I100 through a plurality of display driving lines, and the number of display driving lines should not be construed as a limitation to the invention.

Continuing to refer to FIG. 2, in the present embodiment, the detection circuit unit 130 of the electronic paper display apparatus 100*a* is coupled to the electronic paper display panel 120*a*. The detection circuit unit 130*a* is configured to receive the at least one driving signal S1 to S6 outputted by the electronic paper display panel 120*a*, and detects a display status of the electronic paper display panel 120*a* according to the at least one driving signal S1 to S6. More specifically, the detection circuit unit 130*a* is disposed on the outside of the electronic paper display panel 120*a*, and is connected with the electronic paper display panel 120*a* through a flexible printed circuit (FPC) board 150. However, the invention is not limited thereto. In other embodiments, the detection circuit unit 130*a* also may be disposed in the non-active region 123 of the electronic paper display panel 120*a*, and connected with the electronic paper display panel 120*a* at the same time.

In the present embodiment, a plurality of signal transmitting paths are formed between the image display regions 124_1 to 124_4 of the active region 122 and the detection circuit unit 130*a* through the display driving lines 114. In addition, the display driving lines 114 transmit the at least one driving signal S1 to S6, for example, the driving signals S1 to S5 of the driving signals S1 to S6 to drive the electronic paper display panel 120*a* to display the image I100. In addition, the electronic paper display panel 120*a* outputs the at least one driving signal S1 to S6 using the display driving lines 114, for example, the driving signals S1 to S5 of the driving signals S1 to S6. Then, the detection circuit unit 130*a* receives the at least one driving signal S1 to S6 outputted by the electronic paper display panel 120*a* through the display driving lines 114, for example, the driving signals S1 to S5 of the driving signals S1 to S6, and detects the display status of the electronic paper display panel 120*a* according to the at least one driving signal S1 to S6. In addition, in some embodiments, the image display regions 124_1 to 124_4 also may output the at least one driving signal S1 to S6 to the detection circuit unit 130*a* through the plurality of signal transmitting paths formed by the plurality of display driving lines. The number of display driving lines should not be construed as a limitation to the invention. In addition, the display driving lines 114 of the present embodiment are not required to pass through the active region 122 and any part on the electronic paper display panel 120*a* may be coupled to the detection circuit unit 130*a*. In addition, in some embodiments of the invention, the at least one driving signal S1 to S6 also may be transmitted through the display driving lines 114 to drive the electronic paper display panel 120*a* to display the image I100, however transmitting the at least one driving signal S1 to S6 outputted by the electronic paper display panel 120*a* to the detection circuit unit 130*a* through different display driving lines. In some embodiments of the invention, the at least one driving signal S1 to S6 may be transmitted through different display driving lines to drive the electronic paper display panel 120*a* to display the image I100, however transmitting the at least one driving signal S1 to S6 outputted by the electronic paper display panel 120*a* to the detection circuit unit 130*a* through the display driving lines 114 and it should not be construed as a limitation to the invention.

Continuing to refer to FIG. 2, in the present embodiment, the detection circuit unit 130*a* receives the at least one driving signal S1 to S6, and detects the display status of the electronic paper display panel 120*a* according to the at least one driving signal S1 to S6. Since the at least one driving signal S1 to S6 passes through the electronic paper display panel 120*a*, therefore the detection circuit unit 130*a* may perform detection on the display driving unit 110*a* and the electronic paper display panel 120*a* at the same time according to the at least one driving signals S1 to S6.

Figure 3:
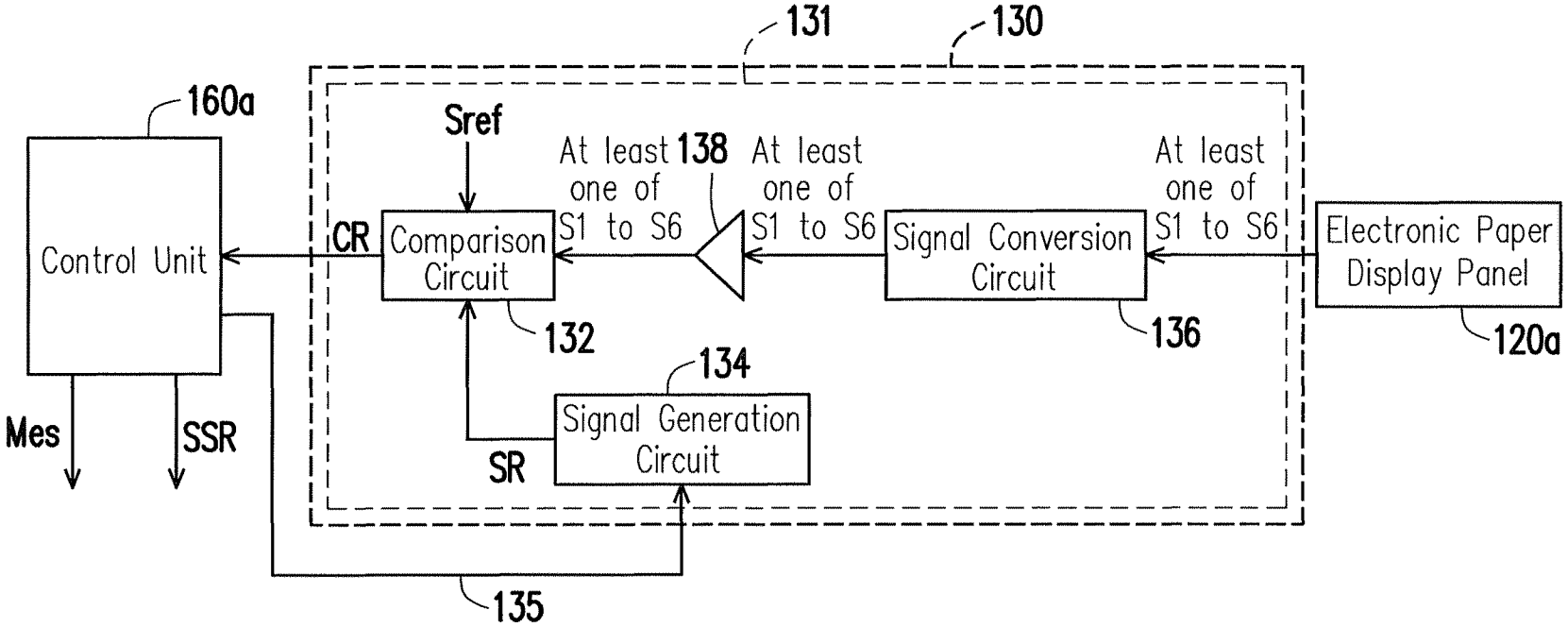
FIG. 3 is a schematic diagram illustrating an internal circuit of a detection circuit unit of FIG. 2.

FIG. 3 is a schematic diagram illustrating an internal circuit of a detection circuit unit of FIG. 2. Referring to FIG. 2 and FIG. 3, in the present embodiment, the detection circuit unit 130*a* includes a signal detection channel 131. The electronic paper display apparatus 100*a* further includes a multiplexer circuit 140 coupled between the electronic paper display panel 120*a* and the signal detection channel 131 of the detection circuit unit 130*a*. More specifically, the detection circuit unit 130*a* of the present embodiment receives the at least one driving signal S1 to S6 at the same time. However, in some embodiments, the detection circuit unit 130*a* may also include a plurality of signal detection channels 131 corresponding to the number of the driving signals S1 to S6, and receiving the at least one driving signal S1 to S6 using the signal detection channels 131 respectively. In addition, in other embodiments, the at least one driving signal S1 to S6 will pass through the multiplexer circuit 140 before entering the detection circuit unit 130*a*. In these embodiments, the multiplexer circuit 140 is configured to switch the signal transmitting path of the display driving circuits 112_1 to 1126 with the detection circuit unit 130*a* (the signal detection channels 131), such that the detection circuit unit 130*a* (the signal detection channels 131) receives the at least one driving signal S1 to S6 generated from the display driving circuits 112_1 to 112_6 sequentially. Therefore, the detection circuit unit 130*a* of these embodiments (the signal detection channels 131) will not receive more than two of the driving signals S1 to S6 generated from the display driving circuits 112_1 to 112_6 at the same. In addition, the detection circuit unit 130*a* may also include the plurality of signal detection channels 131, and may sequentially switch the signal transmitting path of the display driving circuits 112_1 to 112_6 with the signal detection channels through the multiplexer circuit 140 at the same time. In addition, in the present embodiment, the multiplexer circuit 140 is located outside of the electronic paper display panel 120*a*, and the multiplexer circuit 140 is disposed in the detection circuit unit 130*a*. In some embodiments, the multiplexer circuit 140 may also be disposed outside the detection circuit unit 130*a* independently. In addition, in some other embodiments, the electronic paper display apparatus may also not include the multiplexer circuit.

In the present embodiment, the signal detection channels 131 include a comparison circuit 132 coupled to the electronic paper display panel 120*a*, and is configured to receive the at least one driving signal S1 to S6 outputted by the electronic paper display panel 120*a*. In the present embodiment, the comparison circuit 132 performs a comparison of the at least one driving signal S1 to S6 with a reference signal Sref, and detects the display state of the electronic paper display panel 120*a* according to the outputted comparison result CR. The comparison circuit 132 of the signal detection channels 131 outputs the comparison result CR to the control unit 160*a*. The comparison result CR is transmitted to the control unit 160*a* as the detection result. The control unit 160*a* determines the display state of the electronic paper display panel 120*a* according to the comparison result CR, and controls whether the display driving unit 110*a* drives the electronic paper display panel 120*a* to display the image I100 or not according to the determined result. More specifically, the comparison circuit 132 may include a schmitt trigger, or also may include a comparison circuit of another type. In the present embodiment, the comparison circuit 132 is configured to perform a comparison of the at least one driving signal S1 to S6 after being divided with a reference signal Sref. For example, if the display driving unit 110*a* of the electronic paper display apparatus 100*a* and the electronic paper display panel 120*a* are operating normally, the comparison circuit 132 outputs a comparison result CR representing a normal operation to the control unit 160*a*. The control unit 160*a* determines the display state of the electronic paper display panel 120*a* is normal according to the comparison result CR, and controls the display driving unit 110*a* to continue outputting the at least one driving signal S1 to S6 according to the determined result, so as to drive the electronic paper display panel 120*a* to display the image I100. In another example, if any one of the display driving unit 110*a* of the electronic paper display apparatus 100*a* or the electronic paper display panel 120*a* is operating abnormally, for example, has a short circuit, is unable to be powered or is damaged, then the comparison circuit 132 outputs a comparison result CR representing an abnormal operation to the control unit 160*a* after when the comparison circuit 132 performs a comparison of a voltage of the at least one driving signal S1 to S6 with a voltage of the reference signal Sref. The control unit 160*a* determines the display state of the electronic paper display panel 120*a* is abnormal according to the comparison result CR, and controls the display driving unit 110*a* to not output the at least one driving signal S1 to S6 according to the determined result, so as to stop driving the electronic paper display panel 120*a* to display the image I100. In addition, in other embodiments of the invention, settings of the reference signal Sref will be correspondingly adjusted along with the type of the driving signal of the at least one driving signal S1 to S6, for example, a source driver signal, or for example, a gate driver signal. More specifically, in other embodiments of the invention, the reference signal Sref may be adjusted according to different types of the driving signal, or may be correspondingly set according to different circuit designs, and it should not be construed as a limitation to the invention.

Continuing to refer to FIG. 3, in the present embodiment, the signal detection channels 131 (the detection circuit unit 130) further includes a signal generation circuit 134, a signal conversion circuit 136 and a buffer circuit 138. The signal generation circuit 134 is coupled with the comparison circuit 132, and configured to generate a reset signal SR to reset the comparison circuit 132 to the original operational settings. More specifically, the signal generation circuit 134 is coupled with the control unit 160*a* through a reset signal control line 135. The control unit 160*a* controls the signal generation circuit 134 to reset the comparison circuit 132 through the reset signal control line 135. For example, in the electronic paper display apparatus 100 of the present embodiment, the comparison circuit 132 in the signal detection channels 131 receives the at least one driving signal S1 to S6, for example, the driving signals S1 to S5 of the driving signals S1 to S6. After the comparison circuit 132 receives the driving signals S1 to S5 and outputs the corresponding comparison result CR to the control unit 160*a* at a first point in time, the signal generation circuit 134 outputs the reset signal SR to reset the comparison circuit 132 to the original operational settings. Then, at a second point in time, the comparison circuit 132 receives the at least one driving signal S1 to S6 again, for example, the driving signals S3 to S6 of the driving signals S1 to S6. Then, the comparison circuit 132 outputs the comparison result CR of the driving signals S3 to S6 to the control unit 160*a*. Since the signal detection channels 131 include the signal generation circuit 134, the comparison circuit 132 may be maintained in a state of the original operational setting every time when the at least one driving signal S1 to S6 is received, to perform a comparison of the at least one driving signal S1 to S6 with the reference signal Sref, to detect the display state of the electronic paper display panel 120*a*.

In addition, in the present embodiment, the signal conversion circuit 136 is coupled between the comparison circuit 132 and the electronic paper display panel 120*a*, and is configured to divide the voltage of the at least one driving signals S1 to S6, to convert into a voltage suitable for the comparison circuit 132 to receive, and outputs the at least one driving signals S1 to S6 that has been divided. In addition, the buffer circuit 138 is coupled between the signal conversion circuit 136 and the comparison circuit 132, and is configured to receive the at least one driving signal S1 to S6 that have been converted through the conversion circuit 136, and configured to increase the driving ability of the at least one driving signal S1 to S6 that has been divided, for example, increasing the electrical current of the at least one driving signal S1 to S6, so as to be more suitable to be received by the comparison circuit 132. Then, the comparison circuit 132 receives the at least one driving signal S1 to S6 that has passed through the conversion circuit 136 and the buffer circuit 138 and has been converted. More specifically, in a different embodiment of the invention, the voltage and current of the at least one driving signal S1 to S6 may be adjusted through the conversion circuit 136 and the buffer circuit 138, such that the voltage and current of the at least one driving signal S1 to S6 is more suitable to be received by the comparison circuit 132.

Figure 4:
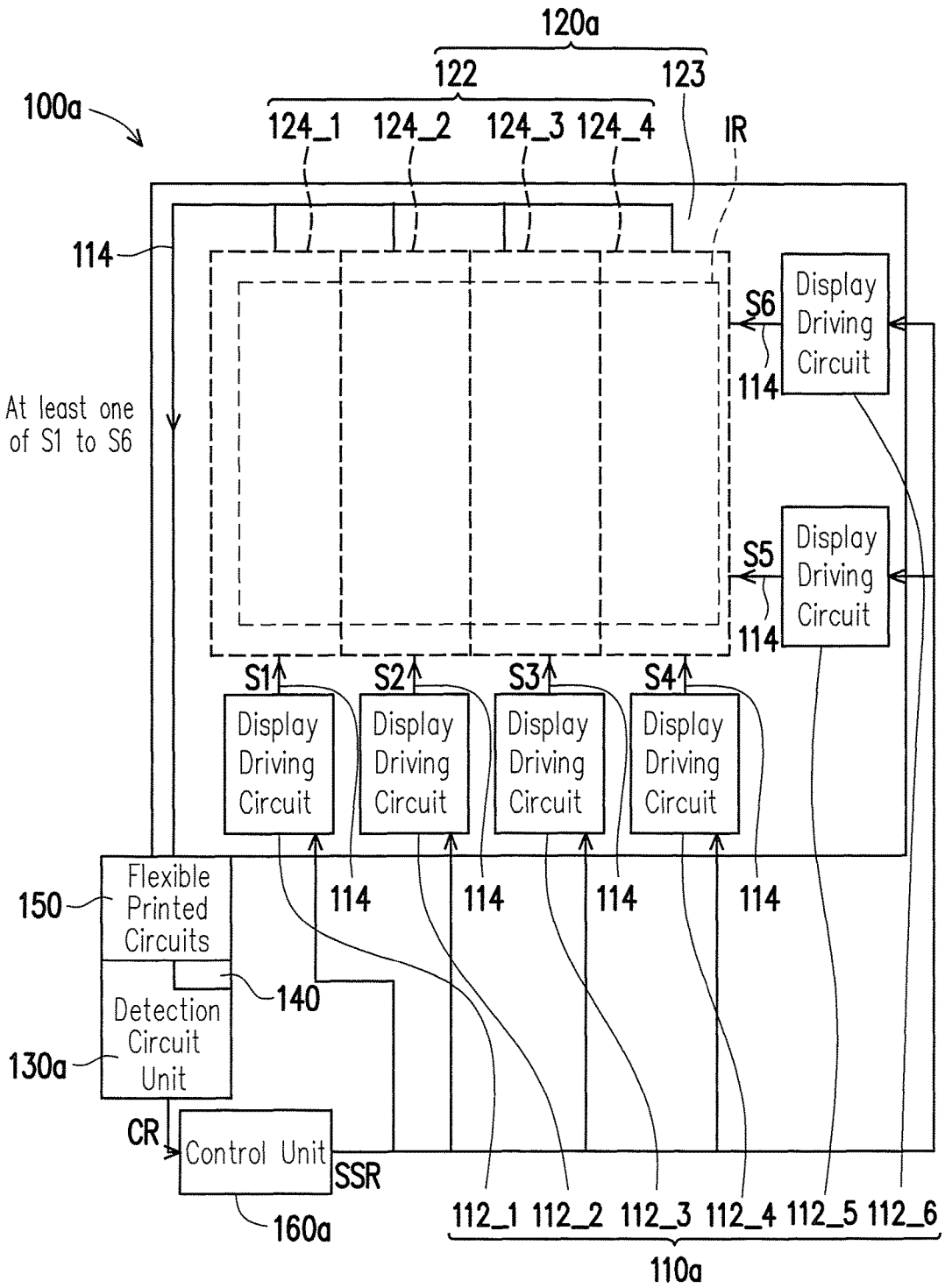
FIG. 4 is a schematic diagram illustrating a reset of an electronic paper display panel of FIG. 2.

FIG. 4 is a schematic diagram illustrating a reset of an electronic paper display panel of FIG. 2. Referring to FIG. 2, FIG. 3 and FIG. 4, in the present embodiment, the control unit 160*a* may output a system reset signal SSR to the display driving unit 110*a* according to the determined result, and the display driving unit 110*a* resets the electronic paper display panel 120*a* according to the system reset signal SSR. For example, when the display driving unit 110*a* and the electronic paper display panel 120*a* of the electronic paper display apparatus 100*a* are all operating normally, then the control unit 160*a* controls the display driving unit 110*a* to continue outputting the at least one driving signal S1 to S6 according to the determined result, so as to drive the electronic paper display panel 120*a* to display the image I100, and is not required to reset the electronic paper display panel 120*a*. When any one of the display driving unit 110*a* or the electronic paper display panel 120*a* of the electronic paper display apparatus 100*a* is operating abnormally (for example, has a short circuit, is unable to be powered or is damaged), then the control unit 160*a* controls the display driving unit 110*a* to not output the at least one driving signal S1 to S6 according to the determined result, so as to stop driving the electronic paper display panel 120*a* to display the image I100. At the same time, the control unit 160*a* may output a system reset signal SSR to the display driving unit 110*a*, and the display driving unit 110*a* resets the electronic paper display panel 120*a* according to the system reset signal SSR. More specifically, in the present embodiment, electronic paper display panel 120*a* displays a reset screen IR after being reset and does not display the image I100. The reset screen IR, for example, is a completely white screen. However, in some embodiments, the reset screen IR may also be a completely black screen, a preset picture or text, or an information display that is set according to the factory of the electronic paper display panel 120*a*, and it should not be construed as a limitation to the invention. In the present embodiment, when the display driving unit 110*a* or the electronic paper display panel 120*a* operates abnormally, the electronic paper display panel 120*a* is reset by the control unit 160*a* outputting the system reset signal SSR, such that the image I100 that is wrong or the image I100 that is incomplete will not be displayed. Therefore, a viewer will not receive outdated information or wrong information due to seeing the image I100 that is wrong or the image I100 that is incomplete. In addition, when the display driving unit 110*a* or the electronic paper display panel 120*a* operates abnormally, such that the display state is abnormal, the control unit 160*a* may also generate a message including the abnormal display status according to the comparison result CR. Therefore, a manager or maintenance personnel of the electronic paper display apparatus 100*a* may be made aware of the abnormal display status of the electronic paper display apparatus 100*a* according to the message, and may further test the electronic paper display apparatus 100*a*, so as to understand the reason for the electronic paper display panel 120*a* of the electronic paper display apparatus 100*a* displaying an abnormal status. In addition, the manager or maintenance personnel of the electronic paper display apparatus 100*a* may perform repair on the electronic paper display apparatus 100*a*, or change out the electronic paper display apparatus 100*a* or perform other processes to solve the problem of the abnormal display state.

Figure 5:
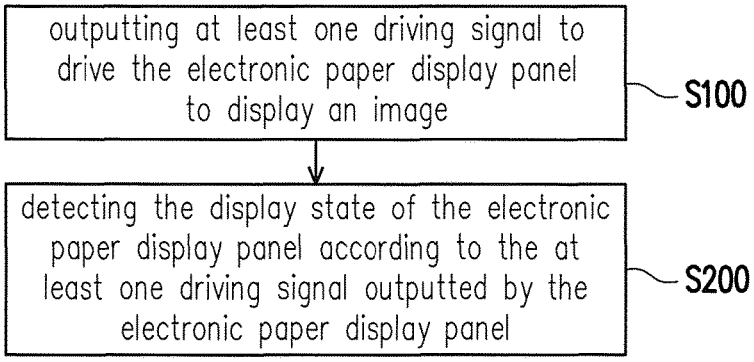
FIG. 5 is a flow diagram illustrating a detection method of an electronic paper display apparatus according to an embodiment of the invention.

FIG. 5 is a flow diagram illustrating a detection method of an electronic paper display apparatus according to an embodiment of the invention. The detection method of an electronic paper display apparatus is applicable at least to, for example, the electronic paper display apparatus 100 of FIG. 1. The detecting method of an electronic paper display apparatus includes the following steps. In a step S100, the driving signal S1 is outputted to drive the electronic paper display panel 120 to display an image. In a step S200, the display state of the electronic paper display panel 120 is detected according to the driving signal S1 outputted by the electronic paper display panel 120. In addition, regarding the detection method of an electronic paper display apparatus of the embodiment of the invention, adequate detail is provided in the descriptions for the embodiments of FIG. 1 and the related embodiments and therefore will not be repeated here.

Figure 6:
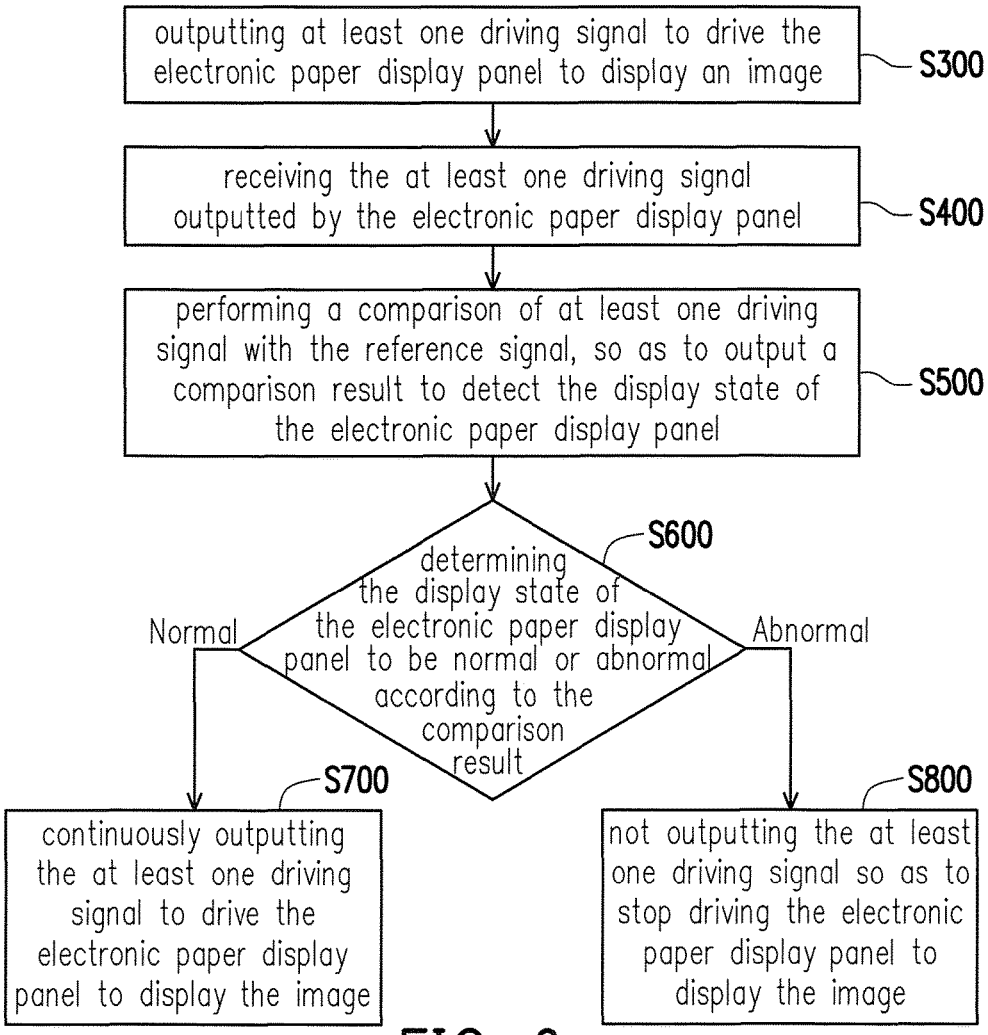
FIG. 6 is a flow diagram illustrating a detection method of an electronic paper display apparatus according to another embodiment of the invention.

FIG. 6 is a flow diagram illustrating a detection method of an electronic paper display apparatus according to another embodiment of the invention. The detection method of an electronic paper display apparatus is applicable at least to, for example, the electronic paper display apparatus 100*a* of FIG. 2. The detecting method of an electronic paper display apparatus includes the following steps. In a step S300, at least one driving signal is outputted (for example, a part of or a portion of the driving signals S1 to S6) to drive the electronic paper display panel 120*a* to display the image I100. In a step S400, the at least one driving signal outputted by the electronic paper display panel 120*a* is received (for example, a part of or a portion of the driving signals S1 to S6). Then, in a step S500, a comparison is performed of the at least one driving signal with the reference signal Sref, so as to output the comparison result CR to detect the display state of the electronic paper display panel 120*a*.

In a step S600, the display state of the electronic paper display panel 120*a* is determined to be normal or abnormal according to the comparison result CR. If the display state of the electronic paper display panel 120*a* is normal, in a step S700, the at least one driving signal is continuously outputted (for example, a part of or a portion of the driving signals S1 to S6) to drive the electronic paper display panel 120*a* to display the image I100.

If the display state of the electronic paper display panel 120*a* is abnormal, in a step S800, the at least one driving signal is not outputted so as to stop driving the electronic paper display panel 120*a* to display the image I100.

In addition, regarding the detection method of an electronic paper display apparatus of the embodiment of the invention, adequate detail is provided in the descriptions for the embodiments of FIG. 2 to FIG. 4 and the related embodiments and therefore will not be repeated here.

In summary, in the embodiments of the invention, since the display driving unit of the electronic paper display apparatus drives the electronic paper display panel to display an image by the at least one driving signal, the detection circuit unit receives the driving signal outputted by the electronic paper display panel, and detect the display status of the electronic paper display panel according to the driving signal, therefore the detection circuit unit may perform detection on the display driving unit and the electronic paper display panel at the same time. In the embodiments of the invention, when the display driving unit or the electronic paper display panel operates abnormally, since the control unit controls the electronic paper display panel to not display the image, and the display driving unit resets the electronic paper display panel according to the system reset signal, therefore the image that is wrong or display of the image that is incomplete will not be displayed.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic paper display apparatus, comprising:

a display driver, configured to generate at least one driving signal;

an electronic paper display panel, coupled to the display driver, wherein the display driver drives the electronic paper display panel to display an image by using the at least one driving signal, and the electronic paper display panel outputs the at least one driving signal; and a detection circuit, coupled to the electronic paper display panel, and configured to receive the at least one driving signal outputted by the electronic paper display panel and detect a display state of the electronic paper display panel according to the at least one driving signal, wherein the detection circuit comprises one or more signal detection channels, each of the signal detection channels comprises:

a comparison circuit, coupled to the electronic paper display panel, and configured to receive the at least one driving signal outputted by the electronic paper display panel and perform a comparison of the at least one driving signal with a reference signal, so as to output a comparison result to detect the display state of the electronic paper display panel, wherein each of the signal detection channels further comprises:

a signal conversion circuit, coupled between the comparison circuit and the electronic paper display panel, and configured to divide the at least one driving signal so as to output the at least one driving signal after being divided; and a buffer circuit, coupled between the signal conversion circuit and the comparison circuit, and configured to increase the driving ability of the at least one driving signal after being divided.

2. The electronic paper display apparatus as claimed in claim 1, wherein the electronic paper display panel comprises:

at least one display driving line, coupled to the display driver, wherein the display driver transmits the at least one driving signal to drive the electronic paper display panel to display the image through the at least one display driving line, wherein the detection circuit receives the at least one driving signal outputted by the electronic paper display panel through the at least one display driving line.

3. The electronic paper display apparatus as claimed in claim 1, wherein the at least one driving signal comprises a plurality of driving signals, and the display driver comprises a plurality of display driving circuits configured to generate the driving signals.

4. The electronic paper display apparatus as claimed in claim 3, wherein the electronic paper display panel comprises a plurality of image display regions, the display driving circuits respectively drive the image display regions to display the image by using the driving signals.

5. The electronic paper display apparatus as claimed in claim 4, wherein the image display regions output the driving signals to the detection circuit through a plurality of signal transmitting paths, and the detection circuit detects the display state of the electronic paper display panel according to the driving signals.

6. The electronic paper display apparatus as claimed in claim 5, further comprising:

a multiplexer circuit, coupled between the electronic paper display panel and the detection circuit, and configured to switch the signal transmitting paths, such that the detection circuit receives the driving signals generated from the display driving circuits sequentially.

7. The electronic paper display apparatus as claimed in claim 1, wherein each of the signal detection channels further comprises: a signal generation circuit, coupled to the comparison circuit, and configured to generate a reset signal to reset the comparison circuit.

8. The electronic paper display apparatus as claimed in claim 1, wherein the one or more signal detection channels output the comparison result to a control unit, and the control unit determines the display state of the electronic paper display panel according to the comparison result.

9. The electronic paper display apparatus as claimed in claim 8, wherein the controller controls whether the display driver drives the electronic paper display panel to display the image or not.

10. A detection method of an electronic paper display apparatus, configured to detect a display state of the electronic paper display apparatus, wherein the electronic paper display apparatus comprises a display driver, an electronic paper display panel and a detection circuit, the detection method of the electronic paper display apparatus comprising:

outputting at least one driving signal to drive the electronic paper display panel to display an image, and detecting the display state of the electronic paper display panel according to the at least one driving signal outputted by the electronic paper display panel, wherein the step of detecting the display state of the electronic paper display panel according to the at least one driving signal outputted by the electronic paper display panel comprises:

receiving the at least one driving signal outputted by the electronic paper display panel; and performing a comparison of the at least one driving signal with a reference signal, so as to output a comparison result to detect the display state of the electronic paper display panel, wherein the step of detecting the display state of the electronic paper display panel according to the at least one driving signal outputted by the electronic paper display panel further comprises:

dividing the at least one driving signal, so as to output the at least one driving signal after being divided; and increasing the driving ability of the at least one driving signal after being divided, wherein in the step of performing a comparison of the at least one driving signal with a reference signal, a comparison of the at least one driving signal after being divided having increased driving ability with the reference signal is performed.

11. The detection method of the electronic paper display apparatus as claimed in claim 10, wherein in the step of outputting the at least one driving signal to drive the electronic paper display panel to display the image, the at least one driving signal is outputted to the electronic paper display panel through at least one display driving line of the electronic paper display panel, and the detection method of the electronic paper display apparatus further comprises:

receiving the at least one driving signal outputted by the electronic paper display panel through the at least one display driving line, so as to detect the display state of the electronic paper display panel.

12. The detection method of the electronic paper display apparatus as claimed in claim 10, wherein the electronic paper display panel comprises a plurality of image display regions, the at least one driving signal comprises a plurality of driving signals, and in the step of outputting the at least one driving signal to drive the electronic paper display panel to display the image, the image display regions are respectively driven to display the image by using the driving signals.

13. The detection method of the electronic paper display apparatus as claimed in claim 12, wherein the image display regions output the driving signals through a plurality of signal transmitting channels respectively, and the detection method of the electronic paper display apparatus further comprises:

switching the signal transmitting paths sequentially, wherein the step of detecting the display state of the electronic paper display panel according to the at least one driving signal outputted by the electronic paper display panel comprises receiving the driving signals from the display driving circuits sequentially.

14. The detection method of the electronic paper display apparatus as claimed in claim 10, the step of detecting the display state of the electronic paper display panel according to the at least one driving signal outputted by the electronic paper display panel comprises: generating a reset signal to reset the comparison result.

15. The detection method of the electronic paper display apparatus as claimed in claim 10, further comprising: determining the display state of the electronic paper display panel according to the comparison result.

16. The detection method of the electronic paper display apparatus as claimed in claim 15, further comprising:

determining whether to output the at least one driving signal to drive the electronic paper display panel to display the image or not according to a determined result.

* * * * *